United States Patent [19]

Sato

[11] Patent Number: 4,502,379

[45] Date of Patent: Mar. 5, 1985

[54] PRESS FRAME

[75] Inventor: Mitsuo Sato, Kanagawa, Japan

[73] Assignee: Aida Engineering Ltd., Sagamihara, Japan

[21] Appl. No.: 514,143

[22] Filed: Jul. 14, 1983

[30] Foreign Application Priority Data

Jul. 14, 1982 [JP] Japan ..... 57-122347

[51] Int. Cl.[3] ..... B30B 15/04

[52] U.S. Cl. ..... 100/214; 72/446; 100/257

[58] Field of Search ..... 100/53, 214, 257, 282; 72/446, 450, 455; 83/701, 859

[56] References Cited

U.S. PATENT DOCUMENTS 3,160,089 12/1964 Platou ..... 100/53 X
4,307,599 12/1981 Wrona ..... 100/53 X

FOREIGN PATENT DOCUMENTS 2731084 1/1979 Fed. Rep. of Germany .
2833829 2/1980 Fed. Rep. of Germany .
1440018 4/1966 France .
644980 10/1950 United Kingdom .
1219794 1/1971 United Kingdom .
1283901 8/1972 United Kingdom .
1328430 8/1973 United Kingdom .
1565559 4/1980 United Kingdom .
572383 9/1977 U.S.S.R. ..... 72/455

*Primary Examiner*—Billy J. Wilhite
*Attorney, Agent, or Firm*—Wenderoth, Lind & Ponack

[57] ABSTRACT

During press operation, the die gap is adjusted by adjustment members extending between the crown and the bed of the press, which adjustment members act in direction to move the two parts apart.

The adjustment members have a hydraulic fluid piston-cylinder means therein, and the distance between the dies is adjusted by expanding or contracting the adjustment members in the axial direction by supplying hydraulic fluid pressure thereto, thereby improving the operation of the press, and making it quite easy to deal with die gap variation during operation of the press and to restore the press to normal operation after a so-called "sticking" condition occurs.

6 Claims, 12 Drawing Figures

PRESS FRAME

BACKGROUND OF THE INVENTION AND PRIOR ART

The present invention relates to a press frame, and more particularly to a frame of a mechanical press which is provided with adjustment means between the crown part of the press which supports the rotating shaft of the press carrying the upper die and the bed part, and which operate in the direction to increase or reduce the distance between the two parts.

Among the types of frames for mechanical presses, there are a frame which is composed of separate parts, i.e., a crown, columns, and a bed, which parts are secured together by tie rods, and a unitary type frame in which all these parts are unified in a single body. In either type frame, the length of the rods connecting the crank shaft and the slide may be increased due to heat from the bearings for the rotation member which is generated when the press is operated, and consequently the distance between the upper die mounted on the slide and the lower die fixed to the bolster is liable to vary between the time of the start of the operation of the press to the time when normal operation is under way.

Reference is made to FIG. 7, which shows a frame of a mechanical press in accordance with the prior art and which is made up of separate parts. Connecting means extend between a crown 1 and a body 2 and are constituted by hollow columns 3 supporting the crown 1 on the bed 2, and tie rods 4 extending through the columns 3. These tie rods 4 extend through and protrude from the crown 1 and the bed 2, and the protruding upper and lower ends are secured by nuts 5, thus holding the press frame in the assembled condition. A slide 6 housed within the columns 3 is connected to rods 7 which are operated by a rotating shaft or crank shaft in the crown 1. An upper die 8 is mounted on the slide 6, and a lower die 9 is mounted on the bed 2.

Because the cross-sectional areas of the connecting rods 7 are small relative to their lengths, heat will cause an increase in length in the longitudinal direction, thereby changing the position of the slide, and reducing the distance between the upper and the lower dies. Such heat can come from the bearings supporting the crank shaft in the crown 1 which is generated during operation of the press.

In a blanking operation, changes in distance between the upper and the lower dies cause the blanking punch to go farther into the die more than desired, and thus damage the dies. In a coining operation, the upper die descends past a predetermined lower position, and thus products come out thinner. In both instances, overload is caused in the drive part of the press frame, reducing the working life of the press.

Also, when two work pieces are accidentally supplied simultaneously during press operation, a very large overload is exerted on the dies, creating a so-called "sticking" condition, a condition in which the power supplied to the crank shaft is insufficient to drive it past the bottom dead center position. In order to restore the operation of the press after occurrence of such a condition, it has been necessary to provide a special device.

In the prior art there has been, as far as is known, only one means for protecting presses from the drawback referred to above, namely means for adjustment of the slide, or a so-called die gap adjustment means.

BRIEF SUMMARY OF INVENTION

It is the object of the present invention to provide means which can be used with either the type of press frames made of separate parts or unitary type frames, and by which die height adjustment and normalization after occurrence of a sticking condition can be achieved by a simple operation.

These objects are achieved according to the present invention by the provision of, in combination, a press frame having a bed, a crown spaced above the bed, connecting means between the crown and the bed supporting the crown on the bed and holding the crown in position relative to the bed, die means on said press frame having upper and lower dies which have a die gap between them when moved to the closest point to each other during operation of the press, and adjustment means mounted between the crown and the bed for exerting a force on the crown to extend the connecting means and thereby adjust the die gap.

DETAILED DESCRIPTION OF THE INVENTION

Figure 1A:
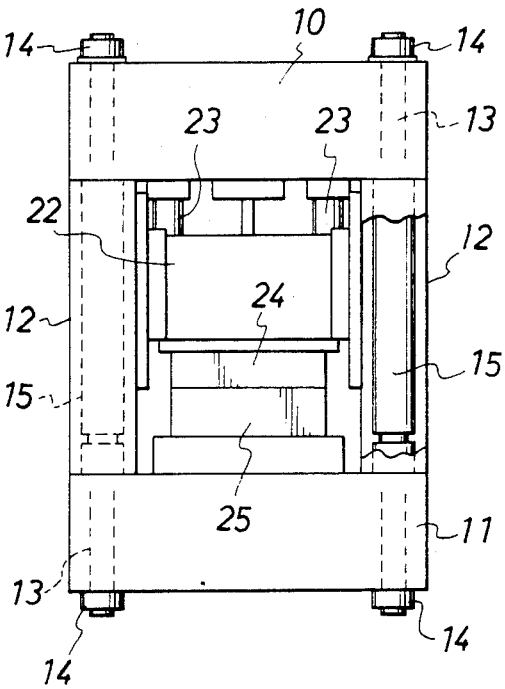
FIG. 1A is a front elevation, partly broken away, of a first embodiment of a press frame according to the present invention.
Figure 1B:
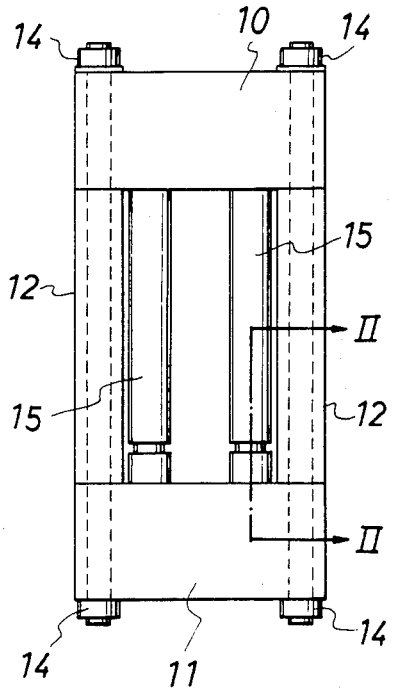
FIG. 1B is a side elevation of the press frame of FIG. 1.
Figure 2:
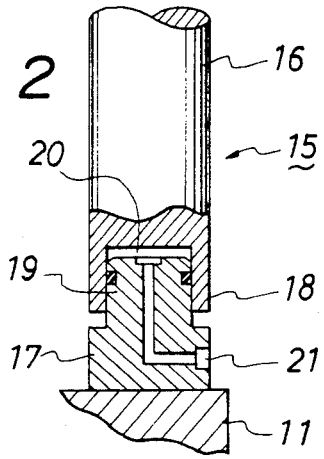
FIG. 2 is a cross-section taken on line II—II of FIG. 1B.
Figure 3A:
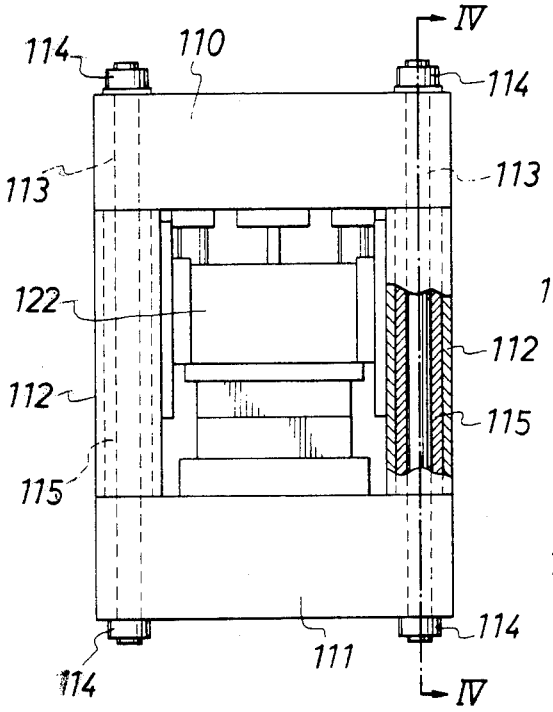
FIG. 3A is a front elevation similar to FIG. 1A of a second embodiment of a press frame according to the present invention.
Figure 3B:
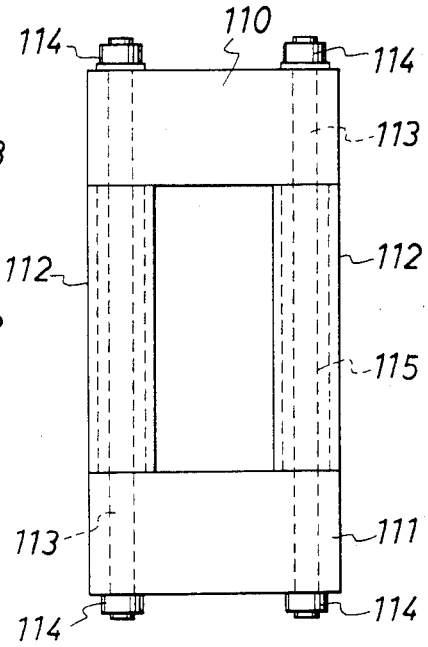
FIG. 3B is a side elevation of the press frame of FIG. 3A.

In the drawings, FIGS. 1A, 1B and 2 show a press frame made up of separate parts and having adjustment means according to the first embodiment of the present invention. A crown 10 is supported on a bed 4 by columns 12 provided at the four corners of the frame, and these parts are connected by tie rods 13 extending through the columns from the crown 10 to the bed 11 and secured by nuts 14.

Adjustment means are provided next to the columns 12, between the crown 10 and the bed 11. Each adjustment means is comprised of a member 15 columnar in shape, and is divided in the middle into an upper part 16 and a lower part 17. Piston-cylinder means are provided in the adjustment means. In this embodiment, the lower end of the upper part 16 has a cylinder chamber 20 therein while the upper end of the lower part 17 has a piston extension 19 thereon fitting in the cylinder chamber 20 to connect the two parts and form the adjustment member 15. A hydraulic fluid pressure supply and discharge passage 21 in the lower part 17 extends into the cylinder chamber 20. By increasing the pressure of the hydraulic fluid supplied through the passage 21, the upper part 16 is transferred in the axial direction so as to force the crown 10 and the bed 11 apart, stretching the rods 13 within their elastic limits. The distance between the crown 10 and the bed 11 is, thus, adjusted by varying the hydraulic fluid pressure.

In the present invention, as in conventional presses, a slide 22 housed within the columns 12 is connected to connecting rods 23 which operate in association with a rotating shaft or crank shaft (not shown) in the crown 10. An upper die 24 is provided on the slide 22 and a lower die 25 is provided on the bed 11.

During the press operation, the distance between the upper and lower die, i.e., the die gap, varies, due to the heating up and cooling of the frame, in accordance with the particular crank shaft and the slide structure inherent in the press as well as the particular dies used. However, the amount of variation will be almost uniform for passage of a given period. Thus, if variations of the conditions in each press is calculated in advance, and the hydraulic fluid pressure to be supplied to the cylinder chamber 20 can be caused to vary in accordance with the values obtained by such calculation, it is possible to maintain a suitable die gap during the entire press operation.

If case overloading between the dies occurs and the so-called "sticking" phenomenon occurs, hydraulic fluid pressure sufficient to increase the height of the crown sufficiently to overcome the phenomenon is supplied to the cylinder chamber 20.

FIGS. 3A, 3B, 4 and 5 show a similar type frame having separate parts according to a second embodiment of the invention and in which tie rods are housed in the adjustment members. A crown 110 is supported by columns 112 on a bed 111 and the parts are connected by tie rods 113. Since columns 112 are large, they are hollow and house the tie rods 113. Adjustment members 115 are also hollow, and are housed within the columns 112 and around the tie rods 113.

Figure 4:
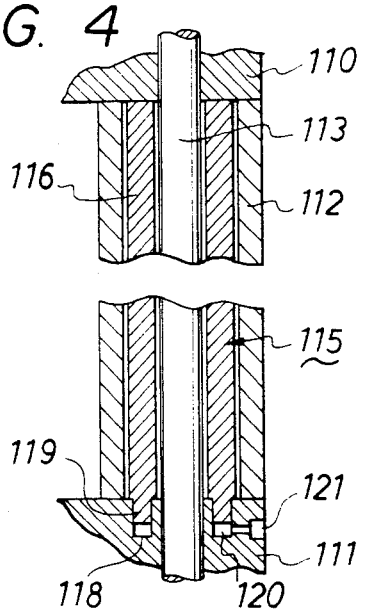
FIG. 4 is a cross-section taken on line IV—IV of FIG. 3A.

The adjustment means 115 shown in detail in FIG. 4 has an upper part 116, and the lower end thereof is shaped as an annular piston 119. The adjustment means further has an annular cylinder 118 provided in the bed 111. A hydraulic fluid supply/discharge passage 121 for supplying hydraulic pressure fluid to the cylinder chamber 120 is provided in the bed 111.

Figure 5:
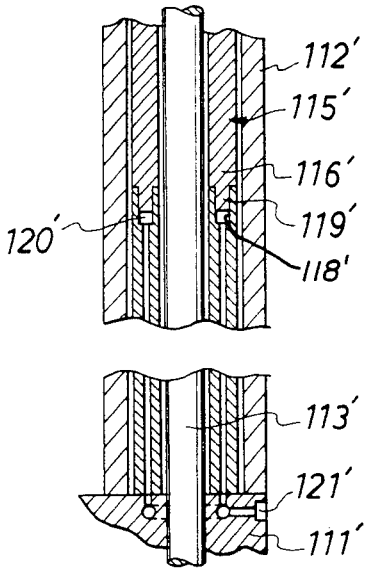
FIG. 5 is a view corresponding to FIG. 4, showing another embodiment of the present invention.

The adjustment means 115' shown in FIG. 5 is comprised of an upper part 116' and a lower part 117', and the lower end of the upper part 116' is shaped as an annular piston 119' and the upper end of the lower part 117 has an annular cylinder 118'.

A hydraulic fluid supply/discharge passage 121' extends from the cylinder chamber 120' of the cylinder 118' through the lower part 117' and the base 111' for supplying hydraulic fluid to the cylinder chamber 120'.

Figure 6A:
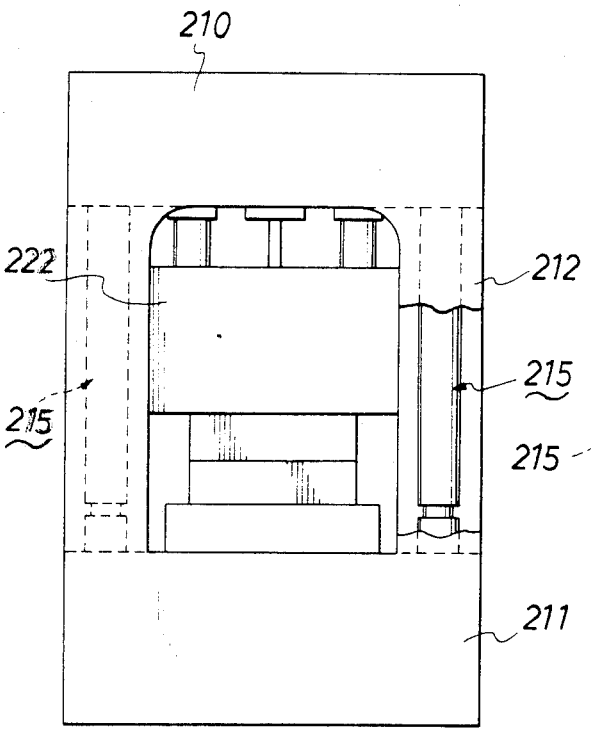
FIG. 6A is a front elevation similar to FIG. 1A of a third embodiment of a press frame according to the present invention.
Figure 6B:
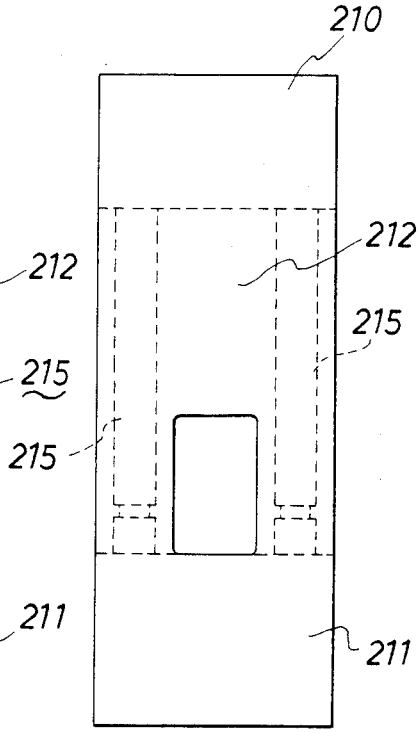
FIG. 6B is a side elevation of the press frame of FIG. 6A.
Figure 7A:
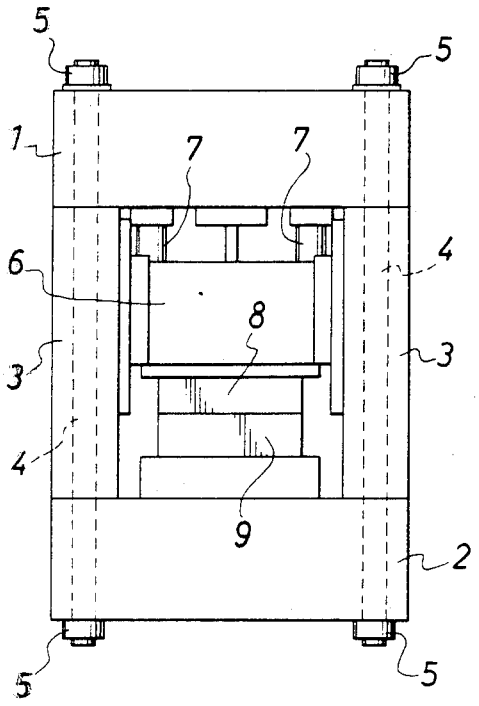
FIG. 7(A) (PRIOR ART)
FIG. 7A is a front elevation similar to FIG. 1A of a press frame in accordance with the prior art.
Figure 7B:
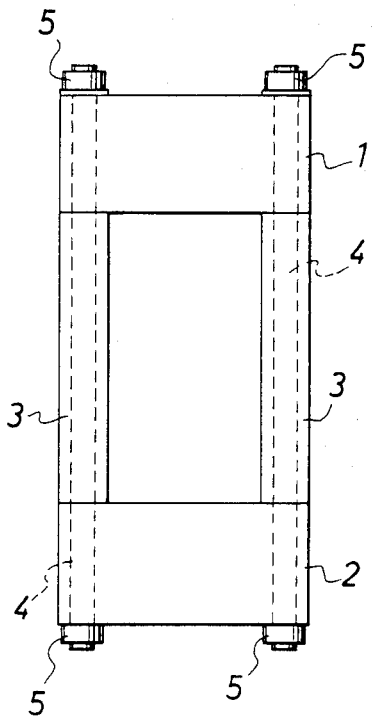
FIG. 7(B) (PRIOR ART)
FIG. 7B is a side elevation view thereof.

FIGS. 6A and 6B show a third embodiment in which the connecting means comprise columns 212 integrally connecting a crown 210 and a bed 211 as a unit. Two adjustment members 215 like those shown in FIGS. 1A and 1B are provided in the front and the rear columns 212. Tie rods are omitted in this structure.

An experiment was performed to determine the relations between the length of time of operation of the press and the changes in the die gap. The press used in the experiment was an 80 ton press, and the temperature of the room where the experiment was performed was 20° C. The press was continuously run at 400 SPM (stroke/minute) without any load under the following four conditions:

A: with no adjustment

B: preheating the connecting rods to 40° C. and without adjustment of the adjustment means (final temperature of connecting rods = 62° C.)

C: operation of the adjustment means. The die gap 0.14 mm was adjusted little by little six times in the first 30 minutes of press operation.

D: preheating connecting rods to 40° C. and operation of the adjustment means. The die gap of 0.12 mm was adjusted little by little seven times in the first 30 minutes of press operation and again at the end of one hour. The final temperature of the connecting rods was 62° C.

Figure 8:
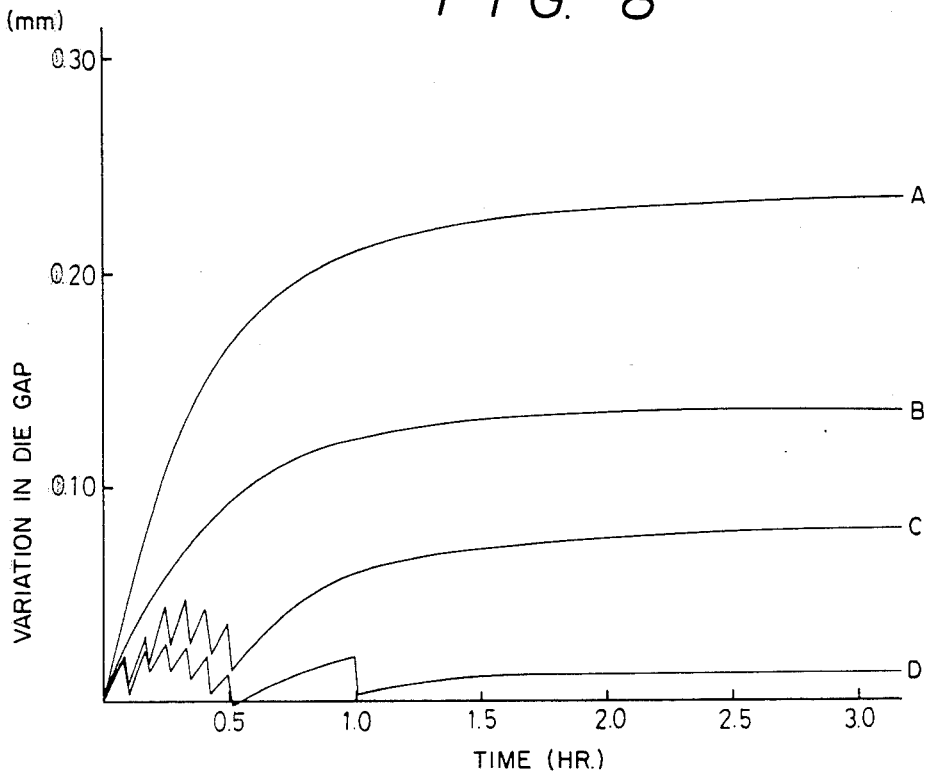
FIG. 8 is a graph showing the relation between the press operation time and variation in die height.

As seen from FIG. 8 showing the results of the experiment for the above described conditions A–D, under all of the conditions, the die gap is stabilized after 1.5 hours from the start of the operation, and there is little difference in the amount of variation after 3 hours. Thus, it will be understood that the normal condition for press operation is reached in the time period of 1.5–2 hours after the start of the operation.

The pressure of the hydraulic fluid supplied to the cylinder of the adjustment means and the size of the die gap are varied in accordance with the size of the cylinder mounted on the frame. If the annular cylinder of the hollow adjustment member shown in FIG. 4 has an outer diameter of 180 mm and an inner diameter of 130 mm, the cross-sectional area of the cylinder chamber is 121.68 $cm^2$. When such chambers are provided at four places on the frame, the total area of the chambers will be 486.72 $cm^2$. If a hydraulic pressure of 100 $kg/cm^2$ is supplied to the chambers, the stretching force on the press frame will be about 48.7 tons.

Amounts of variation in the die gap for hydraulic pressures of 0–350 $kg/cm^2$ supplied to the 80 ton press used in the experiment, are as follows:

| hydraulic pressure supplied ($kg/cm^2$) | total load exerted on frame (tons) | amount of variation in die gap (1/100 mm) |
|---|---|---|
| 0 | 0 | 0 |
| 50 | 24.3 | 3 |
| 100 | 48.7 | 6 |
| 150 | 73.0 | 9 |
| 200 | 97.4 | 12 |
| 250 | 121.7 | 15 |
| 300 | 146.0 | 19 |
| 325 | 158.0 | 23 |
| 350 | 170.0 | 33 |

The results of the foregoing experiment are for an 80-ton press. When a different size press is employed, amounts of variation of the die gap will also be different even if the same amount of hydraulic pressure is supplied. Thus, the amount of variation in the die gap should be measured for the particular press to be employed under the conditions (such as room temperature) in which it will be operated so as to select the optimum amount of hydraulic pressure in accordance with the variation in the die gap.

It should also be understood that reducing or eliminating the hydraulic fluid pressure will permit the press to return to its initial unstressed condition.

What is claimed is:

1. In combination, a press frame having a bed, a crown spaced above the bed, connecting means between the crown and the bed supporting the crown on the bed and holding the crown in position relative to the bed, die means on said press frame having upper and lower dies which have a die gap between them when moved to the closest point to each other during operation of the press, and at least one adjustment part extending between the crown and the bed and piston-cylinder means for exerting a force on said adjustment part, which force is transmitted by said adjustment part to said crown for exerting a force on the crown to extend the connecting means and thereby adjust the die gap.

2. The combination as claimed in claim 1 in which said connecting means comprises columns on the bed and supporting the crown above the bed, and tie rods extending between said crown and said bed for securing said crown, bed and columns together, and said adjustment means comprises at least one adjustment member extending between said bed and said crown and including an upper part and a lower part and piston-cylinder means between said parts for exerting said force.

3. The combination as claimed in claim 2 in which said columns are hollow and said tie rods are in said columns and said upper and lower parts are hollow annular parts around said tie rods.

4. The combination as claimed in claim 1 in which said connecting means comprises columns on the bed and supporting the crown above the bed, and tie rods extending between said crown and said bed for securing said crown, bed and columns together, and said adjustment means comprises at least upper part extending between said bed and said crown and including a piston means, and cylinder means included in said bed into which said piston means fits for forming a piston-cylinder means for exerting said force.

5. The combination as claimed in claim 4 in which one of said columns is hollow, and said upper part and said piston means are within one of said columns.

6. The combination as claimed in claim 1 in which said connecting means comprises columns integral with said crown and said bed and said adjustment means comprises at least one adjustment member extending between said crown and said bed and having an upper part and a lower part and a piston-cylinder means between said parts for exerting said force.

* * * * *